US005858126A

United States Patent [19]

Takashima et al.

[11] Patent Number: 5,858,126

[45] Date of Patent: Jan. 12, 1999

[54] GRAIN-ORIENTED ELECTRICAL STEEL SHEET AND MATERIAL HAVING VERY HIGH MAGNETIC FLUX DENSITY AND METHOD OF MANUFACTURING SAME

[75] Inventors: Kunihide Takashima; Ryutarou Kawamata; Yoshio Nakamura, all of Futtsu; Isao Iwanaga, Kitakyushu; Norito Abe, Himeji, all of Japan

[73] Assignee: Nippon Steel Corporation, Tokyo, Japan

[21] Appl. No.: 792,494

[22] Filed: Jan. 31, 1997

Related U.S. Application Data

[63] Continuation-in-part of Ser. No. 121,805, Sep. 15, 1993, abandoned.

[30] Foreign Application Priority Data

Sep. 17, 1992 [JP] Japan ..... 4-248194
Oct. 23, 1992 [JP] Japan ..... 4-286486

[51] Int. Cl.[6] ..... H01F 1/04

[52] U.S. Cl. ..... 148/308

[58] Field of Search ..... 148/111, 308

[56] References Cited

U.S. PATENT DOCUMENTS

| | | | |
|---|---|---|---|
| 3,940,299 | 2/1976 | Goto et al. | 148/111 |
| 4,642,141 | 2/1987 | Iida et al. | 148/113 |
| 4,692,193 | 9/1987 | Yoshitomi et al. | 148/308 |

FOREIGN PATENT DOCUMENTS

| | | |
|---|---|---|
| 0 101321 | 2/1984 | European Pat. Off. . |
| 0 315948 | 5/1989 | European Pat. Off. . |
| 0 339475 | 11/1989 | European Pat. Off. . |
| 0 390140 | 10/1990 | European Pat. Off. . |
| 0 390142 | 10/1990 | European Pat. Off. . |
| 46-23820 | 7/1971 | Japan . |
| 50-72817 | 6/1975 | Japan . |
| 51-12451 | 4/1976 | Japan . |
| 51-78733 | 7/1976 | Japan . |
| 51-107499 | 9/1976 | Japan . |
| 53-39922 | 4/1978 | Japan . |
| 53-28375 | 8/1978 | Japan . |
| 54-13846 | 6/1979 | Japan . |
| 57-9419 | 2/1982 | Japan . |
| 58-5968 | 2/1983 | Japan . |
| 58-26405 | 6/1983 | Japan . |
| 58-50295 | 11/1983 | Japan . |
| 59-56522 | 2/1984 | Japan . |
| 59-126722 | 7/1984 | Japan . |
| 60-245769 | 12/1985 | Japan . |
| 62-253728 | 11/1987 | Japan . |
| 63-100127 | 5/1988 | Japan . |

OTHER PUBLICATIONS

European Search Report EP 93114924.9 dated Dec. 2, 1993.
Patent Abstracts of Japan, C Field, Jun. 12, 1991, 45C840, vol. 15, No. 231, JP 3–72027 (Mar. 27, 1991).
Patent Abstracts of Japan, C Field, Jun. 9, 1991, 116C794, vol. 15, No. 7, JP 2–258928 (Oct. 19, 1990).
Patent Abstracts of Japan, C Field, Jan. 13, 1988, 120C468, vol. 12, No. 11, JP 62–167822.
Chemical Abstracts, vol. 105, No. 2, Jul. 14, 1986, p. 237, Abstract 10195t, JP 61–34118 (Feb. 18, 1986).
Chemical Abstracts, vol. 117, No. 6, Aug. 10, 1992, p. 297, Abstract 53362K, JP 03–294425 (Dec. 25, 1991).
Chemical Abstracts, vol. 105, No. 2, Jul. 14, 1986, p. 237, Abstract 10194S, JP 61–34117 (Feb. 18, 1986).

*Primary Examiner*—Sikyin Ip
*Attorney, Agent, or Firm*—Kenyon & Kenyon

[57] ABSTRACT

Very high magnetic flux density grain-oriented electrical steel slab containing 2.5 to 4.0 weight percent silicon as an essential component and having a very high magnetic flux density $B_8$ of not less than 1.92 tesla, in which by area not less than 80 percent is accounted for by matrix secondary recrystallization grains having a diameter not larger than 100 mm and not smaller than 10 mm in a direction of cold rolling and not larger than 50 mm and not smaller than 5 mm in a direction perpendicular to the cold rolling direction, and in which, moreover, of the grains in said matrix, not fewer than 50 percent by ratio of number are fine secondary recrystallization grains having an average diameter not larger than 5 mm.

4 Claims, 5 Drawing Sheets

GRAIN-ORIENTED ELECTRICAL STEEL SHEET AND MATERIAL HAVING VERY HIGH MAGNETIC FLUX DENSITY AND METHOD OF MANUFACTURING SAME

This application is a Continuation-in-part of now abandoned Ser. No. 08/121,805 filed on Sep. 15, 1993, now abandoned.

BACKGROUND OF THE INVENTION

1. Field of the Invention

This invention relates to grain-oriented electrical steel sheet and material having very high magnetic flux density for use in the cores of transformers and the like in which {110} <001> Goss texture orientation is promoted to a high level, and a method of manufacturing same.

2. Description of the Prior Art

As a soft magnetic material, grain-oriented electrical steel sheet is used primarily for the core material of transformers and other electrical devices, and with respect to magnetic properties therefore has to have good excitation and core loss characteristics. Usually a $B_8$ (magnetic flux density at a magnetic field strength of 800 A/m) value is used to express excitation characteristics numerically and core loss properties are expressed as a $W_{17/50}$ (core loss per kilogram of material that has been magnetized to 1.7 tesla at 50 Hz) value.

In recent years there has been a sharp increase in societal demands for energy saving and resource conservation, which has brought increased demands for lower core loss values and improved excitation properties in grain-oriented electrical steel sheet, with the demand for lower core loss properties being particularly strong.

Core loss consists of hysteresis loss and eddy current loss. Hysteresis loss depends on such factors as crystal orientation of the steel sheet (in other words, magnetic flux density), purity and internal stress, while factors such as electrical resistance, sheet thickness, grain size, magnetic domain size and steel sheet coating tension contribute to the eddy current loss.

After a long history of careful consideration in terms of production technology the limit has been more or less reached with respect to purity and internal stresses and the like. The silicon content of steel sheet has been raised in an attempt to increase electrical resistance and reduce eddy current loss, but a limit has been reached inasmuch as raising the silicon content degrades workability with respect to manufacturing processes and products. A number of attempts have been made to reduce eddy current loss by decreasing the thickness of the steel sheet, but in addition to the inherent difficulty of achieving the secondary recrystallization needed to obtain a Goss orientation there are a number of other problems involved, with respect to the manufacture of transformers and the like, and as for the same core loss thicker sheet is industrially preferable to thinner sheet, there is also a limit to how much sheet thickness can be reduced.

JP-B-51-12451 and JP-B-53-28375 describe methods for improving the core loss characteristics that a tension coating imparts to steel sheet, but the tensioning effect of these depends on the product orientation, which is to say, the magnetic flux density, and as described in pages 2981 to 2984 of the Journal of Applied Physics, Vol. 41 No. 7 (June 1970), the higher the magnetic flux density $B_8$ the greater the tensioning effect becomes. Thus, with commercial high magnetic flux density electrical steel sheet with a $B_8$ of around 1.92 tesla, there is a limit to how much the core loss characteristics can be improved. Techniques for lowering core loss by artificially fining domain size have been described by JP-B-58-5968 and JP-B-58-26405, but in these methods the core loss reduction effect depends on the magnetic flux density and is limited with respect to the degree of magnetic flux density in current commercial products.

Among the quickest ways to reduce core loss is by fining of secondary recrystallization grains, which was proposed by one of the present inventors in JP-B-57-9419. However, the fact that it is difficult to obtain high magnetic flux density when the size of secondary recrystallization grains is fined limits the use of secondary recrystallization fining as a means of reducing core loss. As the remaining means of reducing core loss, in JP-B-58-50295 the present applicants proposed a method of raising the magnetic flux density $B_8$ from the current level of around 1.92 tesla to a more ideal 2.03 tesla (the saturation magnetic flux density of 3% Si—Fe steel). For the first time this method stably provided a product with a stable magnetic flux density $B_8$ that far exceeded 1.92 tesla. However, the fact that the method involves the application of a temperature gradient during secondary recrystallization, and that application of the method to mill coil form sizes is accompanied by a large loss of thermal energy as one end is heated as the other end is being cooled, are major problems with respect to commercial implementation.

SUMMARY OF THE INVENTION

The object of the present invention is to provide a grain-oriented electrical steel sheet and material having very high magnetic flux density and a method of manufacturing same, in place of the above described core loss reduction means.

As a result of careful, assiduous research into grain-oriented electrical steel sheet having very high magnetic flux density, the present inventors succeeded in stably obtaining a product having a stable magnetic flux density higher than the conventional 1.92 tesla, and upon analyzing the product discovered the first commercial means for obtaining very high magnetic flux density within the limits of the secondary recrystallization grain shape and the slope between ideal Goss orientation. That is, it was found that is was necessary for no fewer than 80 percent by area of grain diameters in the secondary recrystallization matrix to be 50 to 5 mm in the direction perpendicular to the cold rolling direction and 100 to 10 mm in the direction of the cold rolling and for no fewer than 50 percent by number of grain diameters in the secondary recrystallization matrix to have an average grain diameter not greater than 5 mm, including innergranular fine secondary recrystallization grains, and that it was necessary for the crystalline orientation of secondary recrystallization grains and fined secondary recrystallization grains to be within 5 degrees and 10 degrees respectively of the ideal Goss around the TD axis and the ND axis, and that this needs to be the case with respect to no fewer than 90 percent by ratio of number of the grains.

With respect to the manufacture of high magnetic flux density grain-oriented steel sheet in which AlN is used as an inhibitor, it was confirmed that it could be obtained by adding bismuth or a bismuth-containing substance to the molten steel to achieve a ladle analysis content value of Bi=0.0005 to 0.05 weight percent (hereinafter referred to simply as "percent"). While any of the various methods of manufacturing very high magnetic flux density grain-oriented electrical steel sheet that have been proposed may be followed, the following manufacturing method is also possible. Grain-oriented steel sheet less than 0.23 mm thick having a very high magnetic flux density may be manufactured by omitting preliminary cold rolling for the 50 percent or higher cold rolling reduction ratio considered desirable, and by using a full one-time strong rolling method. It also became clear that, concerning the preferred industrial technique of using interpass aging treatment between cold rolling passes, that is to say, the reverse cold rolling method, with the composition system of the present invention the steel could be produced with tandem cold rolling without the aging treatment. Moreover, it was also found that in the case of the continuous high temperature annealing used prior to the final cold rolling, grain-oriented electrical steel sheet having very high magnetic flux density could be obtained using annealing at a lower temperature, and that with respect to the cooling following continuous high temperature annealing, a slower cooling rate could be used.

DETAILED DESCRIPTION OF THE PREFERRED EMBODIMENTS

The inventors carried out various studies on the conditions needed to provide a product with very high magnetic flux density, and by controlling the secondary recrystallization matrix grains and the fine secondary recrystallization grains in the secondary recrystallization matrix grains in grain-oriented electrical steel sheet containing 2.5 to 4.0 percent silicon, succeeded in developing grain-oriented electrical steel sheet having very high magnetic flux density and excellent core loss reduction effect.

Details of the invention will now be described, starting with details of composition conditions. By affecting the specific resistance of electrical steel sheet, the silicon content has a considerable influence on core loss properties. Therefore, a silicon content of less than 2.5 percent is undesirable as the specific resistance of the steel is thereby reduced, increasing the eddy current loss. On the other hand, a content that exceeds 4.0 percent is undesirable as it degrades workability, making it difficult to produce and process the steel.

Figure 1:
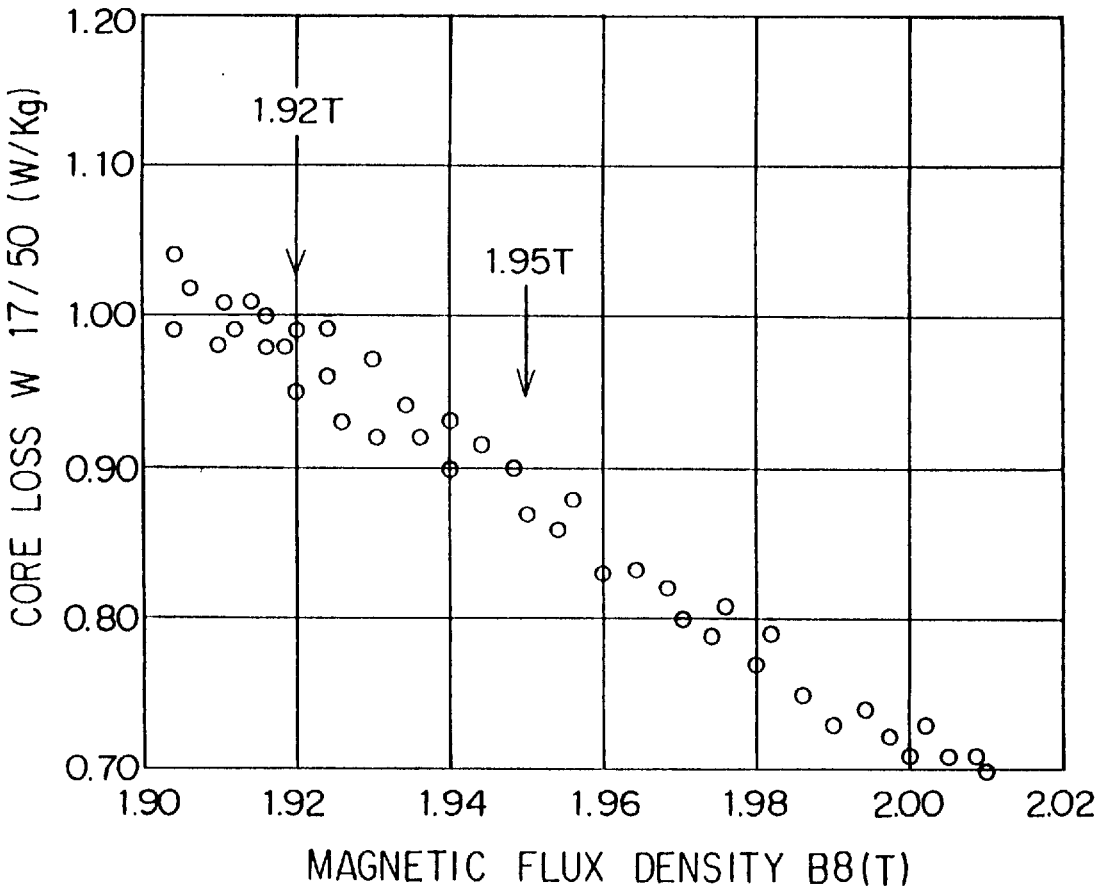
FIG. 1 shows the relationship between core loss $W_{17/50}$ and magnetic flux density $B_8$ in 0.30-mm-thick grain-oriented electrical steel sheet containing 3 percent silicon that has been subjected to magnetic domain control by laser irradiation.

The reasons for the limitations on the magnetic flux density will now be explained. FIG. 1 shows the relationship between core loss and magnetic flux density $B_8$ in 3 percent silicon grain-oriented electrical steel sheet 0.30 mm thick from which the surface glass film has been removed by pickling, on which the measurement has been performed at a tension of 1.5 kg/mm$^2$ after laser beam irradiation at a 5 mm pitch perpendicular to the direction of rolling. As a $W_{17/50}$ core loss of 1.0 W/kg, which is considered good even for a 0.30 mm product, is surpassed with a flux density of 1.92 tesla or above, and a $W_{17/50}$ core loss of 0.90 W/kg which is considered particularly good is surpassed with a flux density of 1.95 tesla or above, in the present invention the magnetic flux density $B_8$ has been limited to not lower than 1.92 tesla.

Secondary recrystallization grain diameter, which is a main focus of the invention, will now be explained. In the following description of the present invention, areal ratio refers to the ratio of the area of coarse grains at an uncut end of a specimen to the total area of the specimen. Numerical ratio refers to the ratio of number of fine secondary recrystallization grains at an uncut end of a specimen to the total number of secondary recrystallization grains in the specimen. As mentioned above, decreasing secondary recrystallization grain diameter usually tends to reduce the magnetic flux density, but in the case of this invention, the results shown in FIGS. 2 and 3 were obtained by the inventors after they studied the relationship between magnetic flux density and grain diameter in grain-oriented electrical steel sheet produced by various methods. The grain diameters were averaged with respect to the maximum lengths of grains of less than 5 mm in diameter (excluding fine grains of less than 5 mm in the direction of the cold rolling) accounting for not less than 80 percent of the area of the secondary recrystallization grain matrix.

Figure 2:
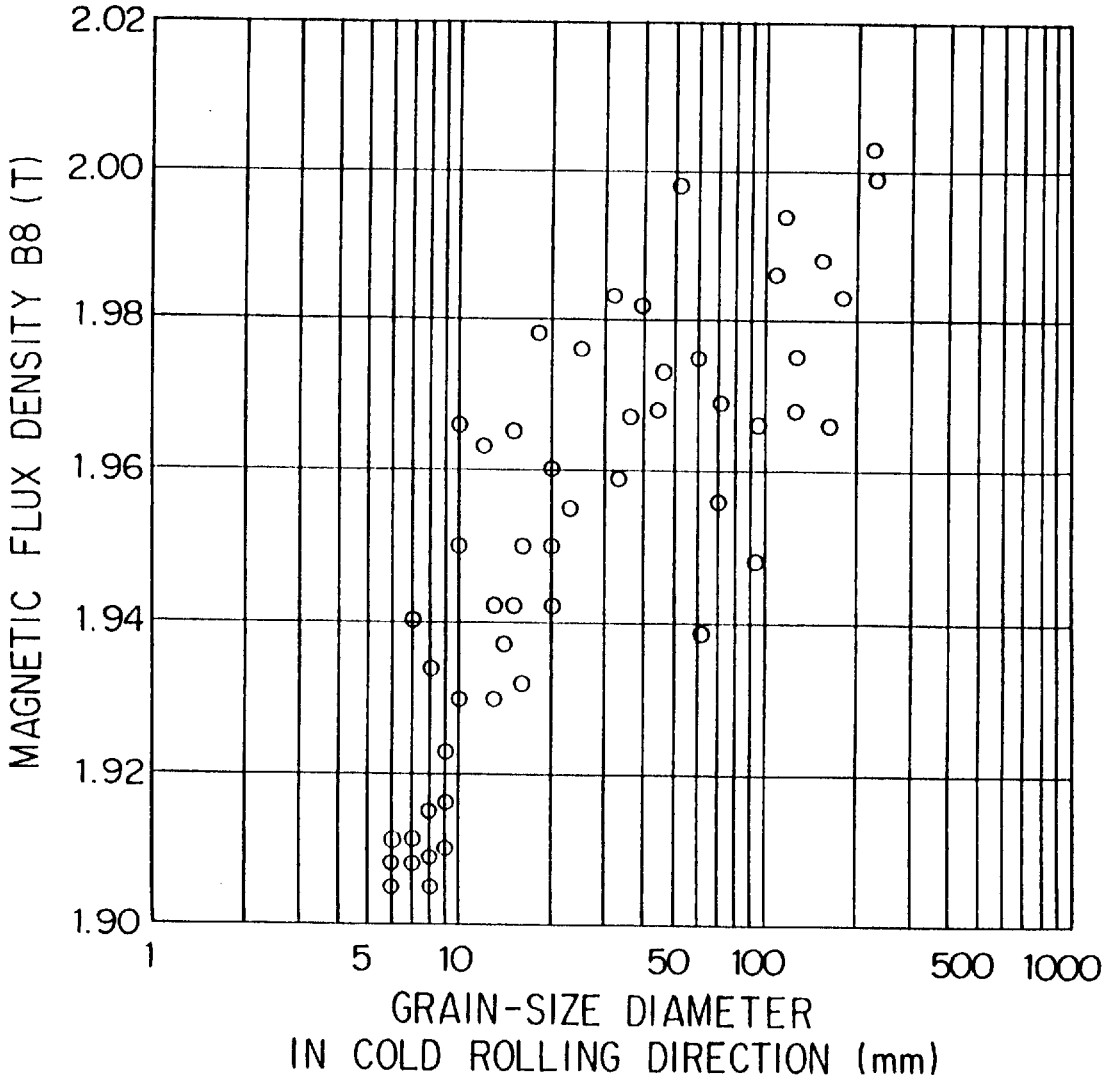
FIG. 2 shows the relationship between magnetic flux density and grain diameter in the cold rolling direction in 0.30-mm-thick grain-oriented electrical steel sheet containing 3.25 percent silicon.

FIG. 2 shows the relationship between grain diameter in the direction of the cold rolling and magnetic flux density. A magnetic flux density of 1.92 tesla or above is obtained stably in the case of grain diameters of not less than 10 mm in the secondary recrystallization grain matrix, and the attainment of 1.95 tesla is limited to grain diameters of not less than 10 mm.

Figure 3:
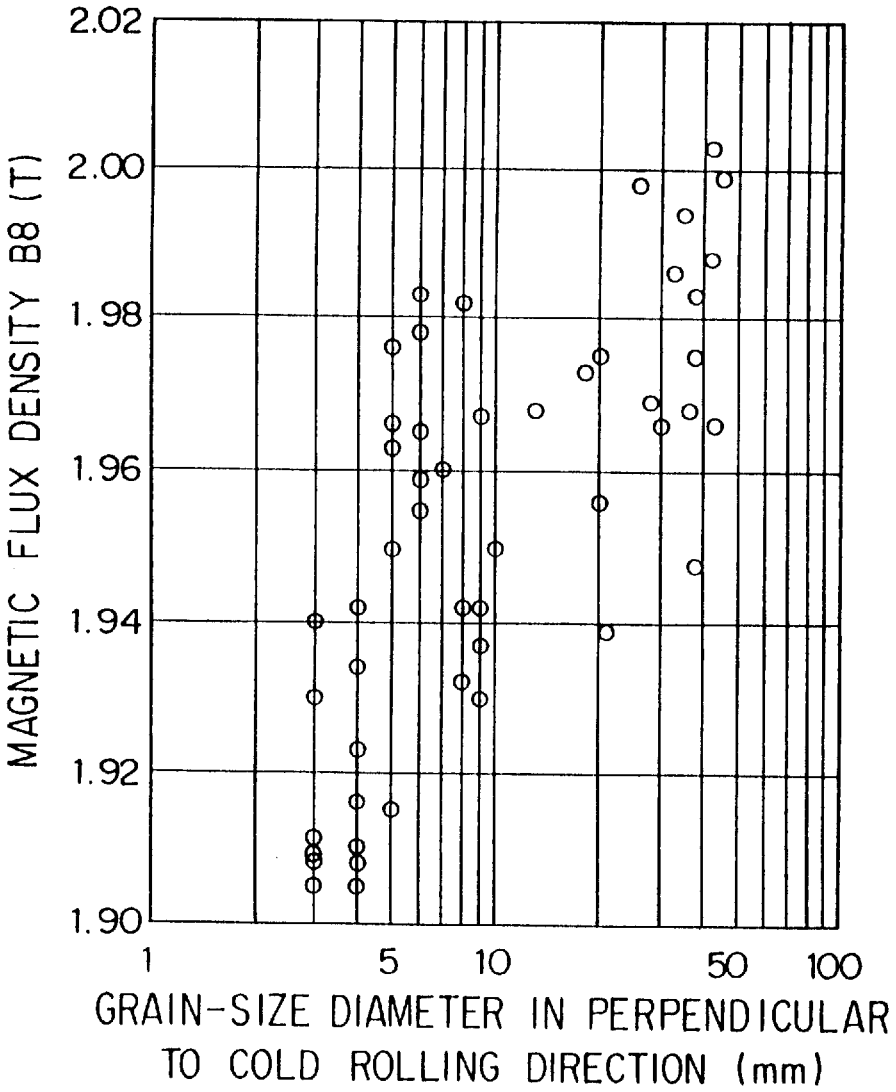
FIG. 3 shows the relationship between magnetic flux density and grain diameter in the direction perpendicular to the cold rolling direction in 0.30-mm-thick grain-oriented electrical steel sheet containing 3.25 percent silicon.

Similarly, from FIG. 3 it can be seen that a magnetic flux density of 1.92 tesla or above is obtained stably, or even an excellent 1.95 tesla or above is obtained, in the case of grain diameters of not less than 5 mm in the direction perpendicular to the cold rolling direction, and said excellent magnetic flux density of 1.95 tesla or above is virtually assured in the case of grain diameters of not less than 10 mm.

Next, with respect to the areal ratio of large grains in the secondary recrystallization grain matrix that are not smaller than the size limit, as shown by the above figures and explanation, secondary recrystallization grains less than 10 mm in diameter in the direction of the cold rolling and less than 5 mm in the direction perpendicular to the direction of cold rolling have a low magnetic flux density, and an areal ratio thereof that exceeds 20 percent will affect the magnetic flux density of the overall product and make it impossible to obtain a product having a magnetic flux density of 1.92 tesla or above, or a very high magnetic flux density of 1.95 tesla or above, therefore said large secondary recrystallized grains are limited to 80 percent or more by area.

Figure 4:
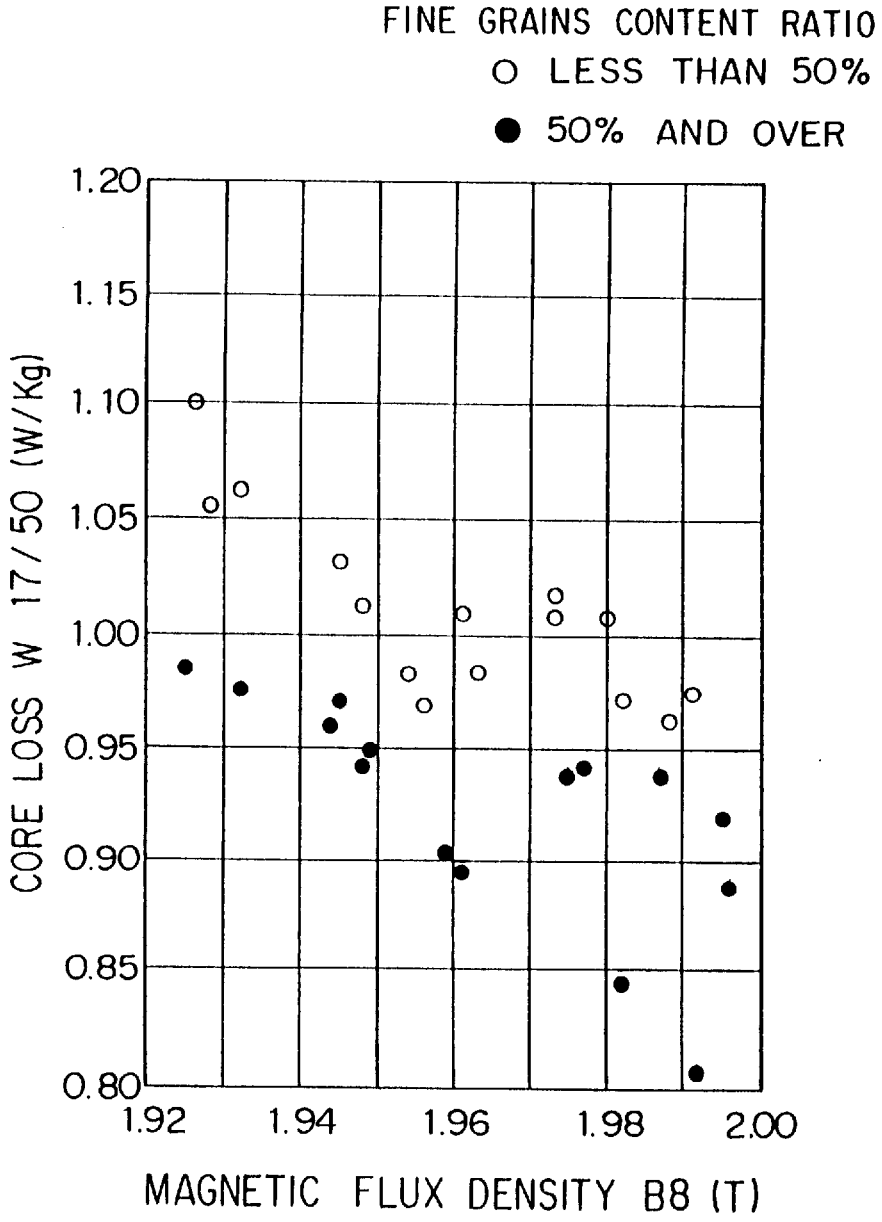
FIG. 4 shows, by content ratio of fine secondary recrystallization grains, the relationship between core loss $W_{17/50}$ and magnetic flux density $B_8$ in 0.30-mm-thick grain-oriented electrical steel sheet containing 3 percent silicon.

The state of fine secondary recrystallization in the matrix grains will now be explained. FIG. 4 shows the relationship between core loss and magnetic flux density in grain-oriented electrical steel sheet product (with a tension coating) 0.30 mm thick containing 3 percent silicon. A rough correspondence can be seen between magnetic flux density and core loss, but unlike in the case of the laser-beam irradiated material of FIG. 1, there is considerable variation in core loss values for the same magnetic flux density. The best core loss values were on a par with those of materials subjected to laser beam irradiation. As a result of detailed studies carried out by the inventors with respect to products having these good core loss values, it was found that, as classified in the figures, when the matrix secondary recrystallization grains include not fewer than 50 percent by numerical ratio of innergranular fine secondary recrystallization grains having a diameter not exceeding 5 mm, a product was obtained which at a flux density of 1.92 tesla or above had a $W_{17/50}$ core loss of less than 1.0 W/kg, or at a flux density of 1.95 tesla or above had a $W_{17/50}$ core loss of 0.95 W/kg.

While the mechanism of this core loss reduction is not clear, in the very high magnetic flux density grain-oriented electrical steel sheet at which the invention is directed, the inventors confirmed that when fine secondary recrystallization grains are not included, magnetic domain walls continue to pass through the crystal grains and thereby become coarser, whereas when fine secondary recrystallization grains are included, new magnetic domains are generated from the fine crystals, giving rise to a domain fining effect.

The crystal orientation distribution will now be explained. That a relationship exists between the magnetic flux density of a grain-oriented electrical steel sheet and the orientation of its secondary recrystallization grains is well known. Up to now, however, the literature has been silent on the orientation distribution when, as in the present invention, the sheet includes both coarse matrix secondary recrystallization grains and fine secondary recrystallization grains within the matrix grains. In particular, no teaching whatsoever has been published regarding the grain orientation distribution of grain-oriented electrical steel sheet which, like that of the present invention, exhibits a flux density of not less than 1.92 tesla and even up to the extremely high level of 1.95 tesla or higher.

The inventors measured the fine orientation distribution features of the very high magnetic flux density grain-oriented electrical steel sheet according to the invention and, as a result, obtained the following new knowledge. Specifically, they learned that for a very high magnetic flux density grain-oriented electrical steel sheet to exhibit a flux density $B_8$ of not less than 1.92 tesla, even of 1.95 tesla or higher, it is necessary that among the matrix secondary recrystallization grains not fewer than 90 percent, by area, be accounted for by grains whose {110} [001] axes are inclined relative to the rolled surface less than 5 degrees around either the TD axis or the ND axis, and that not fewer than 90 percent, by number, be accounted for by fine secondary recrystallization grains whose {110} [001] axes are inclined relative to the rolled surface less than 10 degrees around either the TD axis or the ND axis. Outside these ranges it is difficult to achieve the object of the invention, namely, to obtain a very high magnetic flux density grain-oriented electrical steel sheet exhibiting a flux density $B_8$ of not less than 1.92 tesla and even up to 1.95 tesla or higher.

Further explanation is in order regarding the maximum diameter of the secondary recrystallization matrix grains referred to in the Summary of the Invention. The limitation of the grain diameter in the direction perpendicular to the cold rolling direction to not more than 50 mm is not required from the point of the magnetic properties and was set only because larger grains are seldom obtained in actual products. On the other hand, the grain diameter in the cold rolling direction has a bearing on the aforesaid orientation distribution. If the secondary recrystallization annealing is conducted in the flat state with respect to cut sheet segments, the limitation to not more than 100 mm set by the invention is not required as far as the relationship with grain orientation is concerned. In actual industrial production, however, the secondary recrystallization annealing is ordinarily conducted with respect to coiled sheet. In this case, if the diameter of the secondary recrystallization grains is long in the longitudinal direction of the coil, i.e., the cold rolling direction, the inclination of their {110} [001] axes relative to the rolled surface becomes large around the TD axis at the rear edges of the grains and may come to exceed the 5 degrees limit mentioned above. Because of this, the invention limits the length of the secondary recrystallization grains in the cold rolling direction to not more than 100 mm.

The present invention specifies coarse grains in terms of area ratio. JP-A-60-245769 (JP '769) discloses a grain distribution based on a numerical ratio and does not mention area ratio. In accordance with the present invention, coarse RD (rolling direction) grain diameters have to be from 10 mm to 100 mm and coarse TD (transverse direction) grain diameters have to be from 5 mm to 50 mm. JP '769 describes a TD grain diameter of 1.0 mm to 4.0 mm, but does not state RD grain diameters. Accordingly, JP '769 makes no disclosure or suggestion of the coarse grain sizes required by the present invention. Also, JP '769 teaches a coarse grain numerical ratio of not less than 15 percent, but does not state an upper limit. Considering that, in terms of numbers, at least 40 percent of the grains are fine grains, this means that the upper limit for coarse grains is 60 percent. It therefore follows that JP '769 and the present invention are completely different products.

The present invention and FIG. 1 of JP '769 use different methods to specify the secondary recrystallization grains. Specifically, the grain diameter in FIG. 1 of JP '769 is an average diameter of the secondary recrystallization grains, whereas in the case of the present invention, the size and quantity of coarse secondary recrystallization grains are specified in terms of area ratio. The present application does not define secondary recrystallization grains in terms of an average diameter of secondary recrystallization grains, such as in FIG. 1 of JP '769.

The product of the present invention was attained based on the discovery of a process using the addition of bismuth to produce secondary recrystallization grains that differ from the conventional secondary recrystallization grains of the prior art. The format of the secondary recrystallization grains in the final product of the present invention is not something that can be readily inferred from the prior art.

An explanation of the material constituents used for producing the very high magnetic flux density grain-oriented electrical steel sheet according to the invention will now be given, followed by an explanation of the production process. The very high magnetic flux density grain-oriented electrical steel sheet is produced from the same materials as used in the production of an ordinary high flux density grain-oriented electrical steel sheet using AlN as the main inhibitor, except that it further contains 0.0005 to 0.05 percent bismuth by weight. A high magnetic flux density grain-oriented electrical steel sheet using AlN as its main inhibitor is typically produced by a high temperature slab heating method in which the slab is heated to a high temperature of not lower than 1280° C. at the time of hot rolling (as in the method of JP-B-46-23820). Either of these methods can be used for obtaining a very high magnetic flux density grain-oriented electrical steel sheet by addition of a small amount of bismuth in accordance with this invention. At a bismuth content of less than 0.0005 percent the improvement in flux density is slight, while at a content of more than 0.05 percent the effect of increasing flux density saturates, making addition of more than this amount uneconomical. Since a higher bismuth content also causes edge cracking during hot rolling, its upper limit is set at 0.05 percent. From the viewpoint of flux density improvement effect and negative economic effect (the cost increase and reduced yield from edge cracking resulting from bismuth addition), it is preferable for the bismuth content to be 0.0005 to 0.01 percent.

It is not altogether clear why bismuth affects secondary recrystallization, greatly increases flux density and changes the shape of the secondary recrystallization grains. However, an in-depth study conducted by the inventors has so far clarified the following points. First, there is the inhibitor effect of bismuth itself. Since bismuth has substantially no solid solubility in steel, it is already finely dispersed and exhibits inhibitor effect at the time of solidification. Since it is also unlikely to produce Ostwald growth in the temperature range of the secondary recrystallization, it retains its inhibitor effect up to high temperatures. Second, it also appears to affect the precipitation of AlN and MnS in such a manner as to enhance the fine distribution of these conventional inhibitors. Third, it was found that it changes the form of the oxides on the sheet surface during decarburization annealing, in this way strengthening the shielding effect with respect to the atmosphere during the ensuing secondary recrystallization and thus changing the inhibitor effect through suppression of nitriding and denitriding.

Addition of bismuth during production of a grain-oriented electrical steel sheet material is taught by JP-A-50-72817, JP-A-51-78733 and JP-A-53-39922. However, these patents describe grain-oriented electrical steel sheets that fundamentally contain aluminum and in their specifications explain that bismuth is added in lieu of Sb, an intergranular segregation element. Therefore, differently from in the present invention, bismuth has to be added at not less than 0.01 to 0.02 percent. JP-A-51-107499 and JP-A-63-100127 also teach bismuth addition. Although these patents are similar to the present invention in the point of using AlN as the main inhibitor, like the aforementioned three patents they also define Sb as a substitute intergranular segregation element and require a bismuth content of not less than 0.01 to 0.02 percent. The present invention is thus totally different from these prior art references in technical idea and constitution.

In U.S. Pat. No. 4,692,193 (U.S. Pat. No. '193), bismuth is described as being linked to grain boundary segregation elements Sn, Cu, Se, Sb, As, and Cr. Originally, grain boundary segregation elements were added to suppress coarsening of base metal grains at the time of secondary recrystallization grain growth during finishing annealing, thus stabilizing secondary recrystallization grains. The amount added to achieve this is 0.4 percent, the same amount used to achieve the effect using other grain boundary segregation elements.

Column 4, lines 7 to 13 of U.S. Pat. No. '193 states that adding more than 0.4 percent Sn, Sb, As, Bi or Cr interferes with secondary recrystallization. However, the inventors of the present invention conducted an experiment in which Bi was added to grain-oriented electrical steel which was hot rolled. The results of this experiment showed that edge cracking of the hot-rolled steel sheet became pronounced when the Bi content exceeded 0.05 percent, and that it was not possible to produce hot-rolled sheet when more than that much bismuth was added. Accordingly, 0.05 percent was set as the upper limit for the present invention. U.S. Pat. No. '193 gives no example of the addition of Bi. U.S. Pat. No. '193 gives no suggestion of a range of Bi of from 0.005 to 0.05%. U.S. Pat. No. '193 gives no suggestion that the addition of very small amounts of Bi results in the novel and non-obvious grain format of the present invention.

Concerning this point, it was found that with a far smaller amount of added Bi than suggested by U.S. Pat. No. '193, the present invention attained a high magnetic flux density that was higher than that which could be achieved in the prior art.

The present invention provides grain-oriented electrical steel sheet to which the addition of bismuth imparts a high magnetic flux density of $B_8 \geqq 1.95T$, which is far higher than can be achieved using the conventional technology. U.S. Pat. No. '193, on the other hand, does not disclose an example using a bismuth additive. Concerning $B_8$ as revealed by Table 1 of U.S. Pat. No. '193, U.S. Pat. No. '193 does not obtain the very high magnetic flux density that can be achieved by the present invention.

The inventors of the present invention discovered an entirely new method of producing grain-oriented electrical steel sheet having high magnetic flux density, by using far less added bismuth than suggested in a conventional process as described in U.S. Pat. No. '193. Through careful investigation, the inventors discovered bismuth effect resulting from small bismuth additions that was completely different from the effect described by U.S. Pat. No. '193 and the prior art.

An explanation will now be given with regard to the other material constituents.

C: In the high-temperature slab heating method, a carbon content of less than 0.03 percent is undesirable because it leads to abnormal grain growth during slab heating prior to hot rolling and results in a type of defective secondary recrystallization known as streaks. In the low-temperature slab heating method, a carbon content of less than 0.03 percent is undesirable because secondary recrystallization becomes unstable, and when it does occur, results in very poor magnetic flux density. On the other hand, a carbon content of more than 0.15 percent is undesirable from the industrial viewpoint because the decarburization becomes insufficient at a normal decarburization annealing time period, thus giving rise to magnetic aging in the product.

Si: A silicon content of less than 2.5 percent is undesirable because it increases the product eddy current loss, while a silicon content of greater than 4.0 percent is undesirable because it makes cold rolling difficult at normal temperature.

Mn: In the high-temperature slab heating method, an manganese content of 0.02 to 0.30 percent is necessary for precipitating MnS as an auxiliary inhibitor to AlN. A content below the lower limit is undesirable because the amount of inhibitor becomes insufficient. A content above the upper limit is undesirable because MnS remains undissolved during slab heating and forms coarse precipitates after hot rolling, which weakens the inhibitor effect and causes unstable secondary recrystallization. In the low-temperature slab heating method, a manganese content of 0.10 to 0.80 percent is necessary for obtaining a high magnetic flux density.

S: In the high-temperature slab heating method, a sulfur content of 0.005 to 0.040 percent is necessary for securing MnS as an auxiliary inhibitor. In the low-temperature slab heating method, a sulfur content of less than 0.010 percent is required for preventing partially defective secondary recrystallization owing to sulfur segregation.

Acid soluble Al: Acid soluble aluminum serves as a main inhibitor forming element in the production of a high magnetic flux density grain-oriented electrical steel sheet. In this point, it is also an important constituent in the present invention. An acid soluble aluminum content of less than 0.010 percent is undesirable because the amount of precipitated AlN becomes insufficient and lowers the inhibitor strength. On the other hand, at a content of more than 0.065 percent the AlN precipitates become coarse, and this also lowers the inhibitor strength.

N: Like acid soluble aluminum, nitrogen is a main inhibitor forming element. A content outside the range of 0.0030 to 0.0150 percent disrupts the optimum inhibitor state and, as such, is undesirable.

Sn: Tin is an element effective for stabilizing the secondary recrystallization of thin products. It is therefore required to be present at a content of not less than 0.05 percent. Its upper limit is set at 0.5 percent because its effect saturates above this level and addition of a greater amount only increases cost.

Cu: Copper is an element effective for improving the glass film produced by added tin. A content of less than 0.03 percent produces little effect, while a content in excess of 0.15 percent lowers the magnetic flux density of the product.

The production process conditions will now be explained. One feature of the present invention is the requirement that, in terms of bismuth, the bismuth addition to the molten steel be made at 100 to 5000 g per ton of molten steel. The source of the bismuth is not particularly limited and may be either metallic bismuth or a substance containing bismuth.

The molten steel whose composition has been adjusted in the foregoing manner is cast in the ordinary manner. The casting method is not particularly specified. The cast steel is then hot rolled into a hot-rolled coil. The slab heating temperature at the time of hot rolling preferably not less than 1280° C. in the case of the high-temperature slab heating production method and not more than 1270° C. in the case of the low-temperature slab heating method. The hot-rolled sheet is then subjected to a single stage cold rolling or several stages of cold rolling with interpass annealing to obtain a sheet of final thickness. Since the object is to obtain a high magnetic flux density grain-oriented electrical steel sheet, the final cold rolling reduction ratio (in the case of a single stage cold rolling, the reduction rate therefore) is preferably 65 to 95 percent. In this invention, it is possible to omit the not more than 50 percent reduction ratio that has been considered preferable in the production of a product with a thickness of not more than 0.27 mm (JP-A-59-126722) and to produce a thin product with a thickness of not more than 0.23 mm using the full single-stage one-time heavy reduction cold rolling method. This has not been possible heretofore because use of the full one-time heavy reduction cold rolling method to obtain a thin product with a thickness of not more than 0.23 mm causes a marked decrease in the number of Goss nuclei, so that with the inhibitors of the conventional composition the chance of secondary recrystallization is reduced, resulting in a product with defective secondary recrystallization grains. In this invention, however, the inhibitor strengthening effect obtained by addition of bismuth as explained earlier maintains the inhibitor effect up to high temperatures, making it possible to selectively grow Goss nuclei at the stage where the intergranular movement accelerates in the high-temperature region. This is thought to enable secondary recrystallization to proceed. Although the cold rolling with interpass aging described in JP-B-54-13846 is generally conducted at the time of cold rolling, with the composition of the present invention a product with excellent magnetic flux density can be obtained using the tandem cold rolling method without conducting interpass aging treatment. There is therefore no need to rely on this prior art.

Prior to final cold rolling, the sheet is subjected to the high-temperature annealing JP-B-46-23820 and then quenched. The composition of the present invention makes it possible to extend the range of the high-temperature annealing conditions. One condition that can be broadened is the annealing temperature. High-temperature annealing is ordinarily conducted at a temperature of 950° to 1200° C., preferably 1050° to 1200° C., and more preferably not less than 1100° C. With the composition of the present invention, however, it is possible to obtain a product with excellent magnetic flux density even when annealing is conducted within the temperature range of 850° to 1100° C. This is an advantage from the industrial viewpoint because it not only enables an energy saving proportional to the reduction in annealing temperature but also mitigates high-temperature annealing induced brittleness. It is also possible to broaden the quenching conditions. JP-B-46-23820 calls for conducting the quenching following high-temperature annealing at a cooling rate which lowers the temperature from 950° C. to 400° C. in 2 to 200 seconds. According to FIG. 4 of this prior art reference, higher cooling rates are preferable for obtaining a product with high magnetic flux density. For example, this reference states that for obtaining a magnetic flux density of 1.92 tesla using an annealing temperature of 1150° C. it is necessary for the cooling from 950° C. to 400° C. to be conducted in less than 20 seconds. With the composition of the present invention, however, the cooling condition can be extended toward the gradual cooling side. Specifically, a product exhibiting excellent magnetic flux density can be obtained even with gradual cooling in which the temperature is lowered from 950° C. to 400° C. in 30 seconds or more. In actual industrial scale production, milder cooling conditions make it easier to achieve uniform cooling and to mitigate sheet brittleness by softening the quenched structure. This relaxation of cooling conditions therefore has high industrial significance and can be expected to be vigorously pursued in conjunction with the improvement of core loss property through increased silicon content.

The sheet cold rolled to final product thickness is annealed and then subjected to decarburization annealing in the usual manner. Although the decarburization annealing method is not particularly specified, it is preferably conducted for 30 seconds to 30 minutes at 700° to 900° C. in a mixed gas atmosphere consisting of wet hydrogen or hydrogen and nitrogen.

For preventing sticking during secondary recrystallization annealing and making a glass film, the surface of the decarburization annealed sheet is coated with an annealing separator or ordinary composition in the ordinary manner. The secondary recrystallization annealing is conducted for not less than 5 hours at a temperature of not less 1000° C. in an atmosphere of hydrogen or nitrogen or a mixture of both.

After excess annealing separator has been removed, the sheet is subjected to continuous annealing to straighten coiling curl. An insulating film is applied and baked on at the same time. If necessary, magnetic domain fining treatment is conducted by irradiation with a laser beam or the like. The invention does not particularly specify the magnetic domain fining treatment method.

EXAMPLE 1

An electrical steel sheet slab comprising 0.06 to 0.09 percent carbon, 3.0 to 3.05 percent silicon, 0.08 percent manganese, 0.025 percent sulfur, 0.020 to 0.035 percent acid soluble aluminum, 0.008 percent nitrogen, 0 to 0.15 percent tin, 0 to 0.05 percent copper and 0.0005 to 0.05 percent bismuth and the balance of iron and unavoidable impurities, was heated to 1320° C. and hot rolled to a sheet thickness of 2.3 mm. The hot rolled sheets were then cold rolled to obtain product sheets 0.30 mm and 0.23 mm thick, and between cold railings some of these sheets were subjected to aging treatment 5 times at 200° C. Prior to final cold rolling high temperature annealing was applied at 1120° C. for 2 minutes. The sheets were then subjected to decarburization annealing at 850° C., coated with an annealing separator in which the main constituent was MgO and then subjected to secondary recrystallization annealing at 1200° C. After removing the remaining annealing separator, pieces measuring 60 mm by 300 mm were cut as specimens to measure magnetic properties, and the specimens were annealed at 850° C. to remove internal stresses. Next, an insulating coating was applied to the specimens and baked. The magnetic properties of some of the specimens were measured after the specimens were subjected to laser beam irradiation at 5 mm intervals. After being macrolided with strong acid, specimen grain diameter and the like were measured. The results are listed in Table 1.

Specimens 2 and 3 containing bismuth have a magnetic flux density exceeding 1.95 tesla and an areal ratio of large grains in the secondary recrystallization grain matrix exceeding 80 percent, and a core loss, following laser-beam irradiation, that is far lower than 0.90 W/kg, which for an 0.30 mm thick product can be described as excellent characteristics that surpass the limits of prior art products. Specimens 4 and 5 containing bismuth have a magnetic flux density exceeding 1.95 tesla, an area ratio of large grains in the secondary recrystallization grain matrix exceeding 80 percent, and the matrix large grains also include more than 50 percent fine secondary recrystallization grains, in terms of numerical ratio, so that even without laser-beam treatment they exhibit core loss values not exceeding 0.95 W/kg, which can be described as particularly excellent characteristics for an 0.30 mm thick product. Specimens 9, 10 and 11 are 0.23 mm thick products but like 0.30 mm thick products are within the scope of the present invention, and as laser-beam irradiated products exhibit particularly good characteristics.

TABLE 1

| Spec. No. | Cold-rolled thickness (mm) | Aging applied? Yes/No | Laser-beam irradiated? Yes/No | Si content (%) | Bi content (ppm) | Areal ratio of large grains in matrix (%) | Numerical ratio of fine grains (%) | $B_8$ (T) | $W_{17/50}$ (W/kg) |
|---|---|---|---|---|---|---|---|---|---|
| 1 | 0.30 | No | Yes | 3.02 | 0 | 30 | 10 | 1.918 | 0.98 |
| 2 | 0.30 | No | Yes | 3.01 | 6 | 90 | 30 | 1.987 | 0.75 |
| 3 | 0.30 | No | Yes | 2.98 | 10 | 100 | 50 | 1.997 | 0.71 |
| 4 | 0.30 | No | No | 3.24 | 80 | 100 | 70 | 1.973 | 0.84 |
| 5 | 0.30 | Yes | No | 3.08 | 25 | 80 | 80 | 1.980 | 0.82 |
| 6 | 0.30 | Yes | Yes | 3.25 | 0 | 10 | 70 | 1.932 | 0.91 |
| 7 | 0.23 | No | Yes | 3.20 | 0 | 20 | 40 | 1.908 | 0.81 |
| 8 | 0.23 | Yes | Yes | 3.18 | 0 | 10 | 50 | 1.932 | 0.77 |
| 9 | 0.23 | No | Yes | 3.05 | 20 | 100 | 30 | 1.971 | 0.64 |
| 10 | 0.23 | No | Yes | 3.26 | 42 | 100 | 70 | 1.993 | 0.60 |
| 11 | 0.23 | Yes | Yes | 3.24 | 12 | 80 | 90 | 1.981 | 0.61 |

EXAMPLE 2

Specimens were prepared from 0.30 mm thick sheet produced by the same as Example 1, and the magnetic properties of the specimens were measured. Next, after pickling with strong acid, in each specimen the orientation of 20 crystal grains was measured, using the Laue method. The results are listed in Table 2.

TABLE 2

| Magnetic flux density $B_8$ (T) | Crystal Grain Orientation: Areal percentage of matrix large grains not exceeding 5 degrees | | Numerical percentage of fine grains not exceeding 10 degrees | |
|---|---|---|---|---|
| | Around TD axis | Around ND axis | Around TD axis | Around ND axis |
| 1.903 | 85 | 70 | 80 | 60 |
| 1.935 | 90 | 90 | 90 | 70 |
| 1.983 | 100 | 95 | 95 | 95 |
| 2.005 | 100 | 100 | 100 | 95 |

Note: Crystal orientation is indicated in terms of angle of rotation from ideal Goss orientation in the cold rolling surface direction.

As shown by Table 2, in specimens having a magnetic flux density of 1.95 tesla or higher, matrix grains having an angle of rotation from the ideal Goss, i.e., from the {110} [001] orientation, not exceeding 5 degrees, or not exceeding 10 degrees with respect to fine grains, accounted for not less than 90 percent of matrix large grains in terms of area, and also, not less than 90 percent of fine grains in terms of number, respectively.

EXAMPLE 3

0.0005 to 0.05 percent bismuth was added to steel containing 0.08 percent carbon, 3.05 percent silicon, 0.08 percent manganese, 0.025 percent sulfur, 0.025 percent acid soluble aluminum and 0.009 percent nitrogen. The slab was heated to 1320° C. and hot rolled to a sheet thickness of 2.3 mm. The hot rolled sheets were then annealed at 1100° C., and after being pickled were subjected to aging treatment 5 times at 250° C. between cold rolling passes, whereby the sheets were cold rolled to a sheet thickness of 0.30 mm. The sheets were then subjected to decarburization annealing at 850° C., coated with an annealing separator in which the main constituent was MgO and then subjected to secondary recrystallization finish annealing at 1200° C. The 0.30-mm-thick specimens listed in Table 3 were subjected to magnetic domain refinement by laser irradiation at a pitch of 5 mm. Table 3 also lists the measured magnetic properties of the specimens.

TABLE 3

| Bi content (%) | $B_8$ (T) | $W_{17/50}$ (W/kg) |
|---|---|---|
| None added | 1.910 | 1.01 |
| 0.0005 | 1.971 | 0.79 |
| 0.002 | 2.002 | 0.71 |
| 0.010 | 2.008 | 0.70 |
| 0.050 | 1.978 | 0.75 |

Table 3 shows that steel according to the present invention containing added bismuth exhibited a very high magnetic flux density, and after laser irradiation, therefore exhibited a very good core loss property of less than 0.90 W/kg, and a best value of 0.70 W/kg. Although the material was 0.30-mm-thick steel sheet, the core loss values obtained following magnetic domain refinement treatment were as good as, or better than, the core loss values exhibited by normal 0.23-mm-thick high-magnetic-flux-density grain-oriented electrical steel sheet.

EXAMPLE 4

0.009 percent bismuth was added to steel containing 0.09 percent carbon, 3.3 percent silicon, 0.07 percent manganese, 0.025 percent sulfur, 0.026 percent acid soluble aluminum, 0.009 percent nitrogen, 0.15 percent tin and 0 to 0.07 percent copper. The subsequent steps were the same as those of Example 3, except that the sheet was cold rolled to a thickness of 0.23 mm. The characteristics of the products thus obtained are listed in Table 4.

TABLE 4

| Bi content (%) | Cu content (%) | $B_8$ (T) |
|---|---|---|
| 0.009 | None added | 1.993 |
| 0.009 | 0.07 | 2.005 |

As is clear from Table 4, a product with excellent magnetic flux density can be obtained by the addition of bismuth even to steel to which tin or tin and copper has been added.

EXAMPLE 5

The products obtained in Example 4 were subjected to magnetic domain fining treatment using laser-beam irradiation at a pitch of 5 mm. The results are listed in Table 5.

TABLE 5

| Bi content (%) | Cu content (%) | $B_8$ (T) | $W_{17/50}$ (W/kg) |
|---|---|---|---|
| 0.009 | None added | 2.000 | 0.62 |
| 0.009 | 0.07 | 2.013 | 0.60 |

As is clear from Table 5, the specimens of this Example have a very high magnetic flux density and after grain fining attain an excellent core loss of 0.6 W/kg.

EXAMPLE 6

0.008 percent bismuth was added to steel containing 0.06 percent carbon, 3.2 percent silicon, 0.13 percent manganese, 0.007 percent sulfur, 0.028 percent acid soluble aluminum, 0.008 percent nitrogen and 0 to 0.12 percent tin. The slab was heated to 1150° C. and hot rolled to a sheet thickness of 1.8 mm. The hot rolled sheets were then annealed at 1100° C., and after being pickled were subjected to 5 aging treatments at 180° C. between cold rolling passes, whereby the sheets were cold rolled to a thickness of 0.23 mm, subjected to decarburization annealing at 830° C. and then subjected to nitriding treatment for 30 seconds at 750° C. in an atmosphere containing ammonium. The steel sheets were then coated with an annealing separator in which the main constituent was MgO and subjected to finish annealing at 1200° C. The characteristics of the products thus obtained are listed in Table 6.

TABLE 6

| Bi content (%) | Sn content (%) | $B_8$ (T) |
|---|---|---|
| 0.008 | None added | 1.988 |
| 0.008 | 0.12 | 1.992 |

As is clear from Table 6, a product with very high magnetic flux density can be obtained by the addition of bismuth even to steel thus produced the low-temperature slab heating method.

EXAMPLE 7

100 to 5000 g(/melt T) metallic bismuth was added to a steel melt containing 0.08 percent carbon, 2.98 percent silicon, 0.08 percent manganese, 0.023 percent sulfur, 0.025 percent acid soluble aluminum and 0.008 percent nitrogen. The same steps as those of Example 3 were used, and the magnetic characteristics of the products were measured. The results are listed in Table 7.

TABLE 7

| Added Bi (g/molten steel T) | $B_8$ (T) | $W_{17/50}$ (W/kg) |
|---|---|---|
| None added | 1.919 | 1.00 |
| 100 | 1.958 | 0.72 |
| 500 | 1.998 | 0.71 |
| 1000 | 2.002 | 0.70 |
| 5000 | 1.973 | 0.72 |

From Table 7 it can be seen that, by adding matallic bismuth, an excellent product was obtained having a magnetic flux density $B_8$ not lower than 1.95 tesla, which could not be obtained with the methods of the prior art.

EXAMPLE 8

No bismuth or 0.010 percent bismuth was added to steel containing 0.08 percent carbon, 3.05 percent silicon, 0.08 percent manganese, 0.025 percent sulfur, 0.026 percent acid soluble aluminum and 0.008 percent nitrogen. The slabs were heated to 1320° C. and rolled to a sheet thickness of 2.3 mm. The hot rolled sheets were then annealed at 1100° C. and, after being pickled, were either subjected to aging treatment 5 times at 250° C. between cold rolling passes or not subjected to aging treatment, whereby cold rolled sheets 0.30 mm thick were obtained using two sets of conditions. The sheets were then subjected to decarburization annealing at 850° C., coated with an annealing separator in which the main constituent was MgO and then subjected to secondary recrystallization finish annealing at 1200° C. The results of the magnetic measurements are listed in Table 8.

TABLE 8

| Bi content (%) | Interpass aging applied? Yes/No | $B_8$ (T) |
|---|---|---|
| None added | Yes | 1.917 |
| | No | 1.882 |
| 0.010 | Yes | 1.997 |
| | No | 2.001 |

It can be seen from Table 8 that products with very high magnetic flux density could be obtained through the addition of bismuth, and that even when no interpass aging was used, unlike when no bismuth was added there was either no degradation in the magnetic flux density or there was a slight improvement. This is the direct opposite to what is anticipated when the prior art technologies are used.

EXAMPLE 9

No bismuth or 0.06 percent bismuth was added to steel containing 0.09 percent carbon, 3.2 percent silicon, 0.08 percent manganese, 0.026 percent sulfur, 0.026 percent acid soluble aluminum, 0.008 percent nitrogen, 0.15 percent tin and 0.07 percent copper. The slabs were heated to 1320° C. and rolled to a sheet thickness of 2.3 mm. The hot rolled sheets were then annealed at 850° C. to 1100° C. and, after being pickled, were either subjected to aging treatment 5 times at 250° C. between cold rolling passes or not subjected to aging treatment, whereby cold rolled sheets 0.30 mm thick were obtained. The sheets were then subjected to decarburization annealing at 850° C., coated with an annealing separator in which the main constituent was MgO and then subjected to secondary recrystallization finish annealing at 1200° C. Table 9 shows the relationship between bismuth content, hot-rolled sheet annealing temperature, the number of bending repetitions the annealed sheets were subjected to and the magnetic flux density $B_8$ of the product sheets.

TABLE 9

| Bi content (%) | Annealing temperature (°C.) | No. of bendings | $B_8$ (T) |
|---|---|---|---|
| None added | 950 | >20 | 1.817 |
| | 1120 | 4 | 1.915 |
| 0.006 | 850 | >20 | 1.953 |
| | 1050 | 18 | 1.991 |
| | 1150 | 2 | 1.968 |

It can be seen from Table 9 that by adding bismuth, products could be obtained having a very high magnetic flux density not achievable with the methods of the prior art, and that even with a hot-rolled sheet annealing temperature not exceeding 1100° C., unlike when no bismuth was added there was either no degradation in the magnetic flux density or there was a slight improvement. Such an effect cannot be anticipated from the prior art. Furthermore, while with an annealing temperature that does exceed 1100° C. the number of bendings of the annealed sheet is less than the 5 that is used as a guide in the case of commercial sheet on a continuous line, with the steel of the present invention to which bismuth has been added, more than 5 bendings can be ensured with an annealing temperature not exceeding 1100° C.

EXAMPLE 10

No bismuth or 0.010 percent bismuth was added to steel containing 0.09 percent carbon, 3.3 percent silicon, 0.07 percent manganese, 0.025 percent sulfur, 0.027 percent acid soluble aluminum, 0.009 percent nitrogen and 0.15 percent tin. The hot rolled sheets were annealed at 1050° C. and then cooled either by quenching in 100° C. water, or by forced air-cooling, or by atmospheric cooling, and after being pickled the sheets were cold rolled to a thickness of 0.30 mm. The sheets were then subjected to decarburization annealing at 850° C., coated with an annealing separator in which the main constituent was MgO and then subjected to secondary recrystallization finish annealing at 1200° C. Table 10 shows the relationship between bismuth content, hot-rolled sheet annealing and cooling conditions, the number of bending repetitions the annealed sheets were subjected to and the magnetic flux density $B_8$ of the product sheets.

TABLE 10

| Bi content (%) | Cooling conditions | Cooling rate °C./s | No. of bendings | $B_8$ (T) |
|---|---|---|---|---|
| None added | Quenched in 100° C. water | 30 | 8 | 1.919 |
| | Atmospheric cooling | 4 | >20 | 1.852 |
| 0.010 | Quenched in 100° C. water | 30 | 2 | 1.968 |
| | Forced air-cooling | 13 | 18 | 1.982 |
| | Atmospheric cooling | 4 | >20 | 1.961 |

It can be seen from Table 10 that by adding bismuth, products could be obtained having a very high magnetic flux density not achievable with the methods of the prior art, and that even when the annealing is followed by gradual cooling in water no hotter than 100° C., unlike when no bismuth was added there was either no degradation in the magnetic flux density or there was a slight improvement. Such an effect cannot be anticipated from the prior art. Furthermore, while with a cooling rate of 30° C./s the number of bendings of the annealed sheet is less than the 5 that is used as a guide in the case of commercial sheet on a continuous line, with the steel of the present invention to which bismuth has been added, more than 5 bendings can be ensured with the gradual cooling conditions used.

EXAMPLE 11

An electrical steel sheet slab comprising 0.06 to 0.09 percent carbon, 3.23 to 3.25 percent silicon, 0.08 percent manganese, 0.025 percent sulfur, 0.020 to 0.035 percent soluble aluminum, 0.008 percent nitrogen, 0 to 0.15 percent tin, 0 to 0.05 percent copper, bismuth, and the balance of unavoidable impurities, was heated to 1320° C. and hot rolled to a sheet thickness of 2.3 mm. The hot rolled sheets were then cold rolled to obtain product sheets 0.30 mm and 0.23 mm thick, and between cold rollings some of these sheets were subjected to 5 aging treatments at 200° C. Prior to final cold rolling high temperature annealing was applied at 1120° C for 2 minutes. The sheets were then subjected to decarburization annealing at 850° C., coated with an annealing separator in which the main constituent was MgO and then subjected to secondary recrystallization annealing at 1200° C. After removing the remaining annealing separator, pieces measuring 60 mm by 300 mm were cut as specimens to measure magnetic properties, and the specimens were annealed at 850° C. to remove internal stresses. A glass film was then baked onto the specimens. The magnetic properties of some of the specimens were measured after the specimens were subjected to laser beam irradiation at 5 mm intervals. After being macrolided with strong acid, specimen grain diameter and the like were measured. The results are listed in Tables 11 and 12.

Specimens 3 and 4 containing bismuth have a magnetic flux density exceeding 1.95 tesla and a matrix coarse grain surface area ratio exceeding 80 percent. With more than 50 percent of the matrix coarse grains also containing fine secondary recrystallization grains, the core loss, following laser-beam irradiation, was lower than 0.90 W/kg, which is excellent for 0.30-mm-thick product sheet.

Specimens 5 and 6 containing bismuth have a magnetic flux density exceeding 1.95 tesla and a matrix coarse grain surface area ratio exceeding 80 percent. With more than 50 percent of the matrix coarse grains also containing fine secondary recrystallization grains, the core loss, even without laser-beam irradiation treatment, was lower than 0.95 W/kg, which is excellent for 0.30-mm-thick product sheet.

Specimen 2 containing bismuth has a magnetic flux density exceeding 1.95 tesla. However, although the matrix coarse grain surface area ratio exceeds 80 percent, because the numerical ratio of coarse grains containing innergranular fine grains was below 50 percent, core loss following laser-beam irradiation treatment did not approach the core loss values of specimens 3 and 4.

Specimens 8, 9, 10 and 11 are 0.23 mm thick products but like 0.30 mm thick products are within the scope of the present invention, and as axis-controlled products, following laser-beam irradiation, exhibited very good characteristics.

A characterizing feature of the present invention is that it enables steel product to be obtained having very good magnetic properties, regardless of whether or not interpass aging is used.

Figure 5:
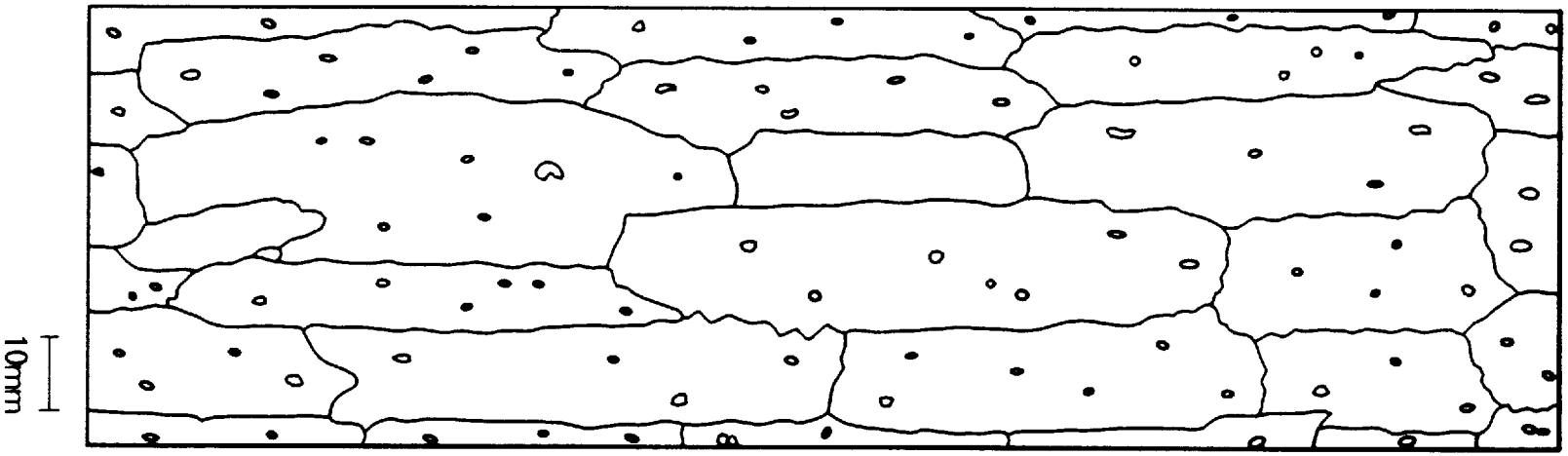
FIG. 5 illustrates the observed texture of the steel.

FIG. 5 illustrates the observed structure of steel specimen 5. The entire matrix is covered with coarse grains as defined by the present invention. Of 13 coarse grains at an uncut end of the specimen, 11 contain fine grains. Measurements revealed that the surface areal ratio of coarse grains was 99 percent and the numerical ratio of coarse grains containing fine grains was 84.6 percent. Also, as shown in FIG. 5, the numerical ratio of fine grains in 81.7 percent (58 fine grains and 13 coarse grains), so an excellently low loss was attained in specimen 5 even though it was not subjected to laser beam treatment.

TABLE 11

| Spec. No. | Cold-rolled thickness (mm) | Aging applied? Yes/No | Laser-beam irradiated? Yes/No | Si content (%) | Bi content (ppm) | Areal ratio of large grains in matrix (%) | Numerical ratio of fine grains (%) | $B_8$ (T) | $W_{17/50}$ (W/kg) |
|---|---|---|---|---|---|---|---|---|---|
| 1 | 0.30 | Yes | Yes | 3.23 | 0 | 35 | 10 | 1.919 | 0.98 |
| 2 | 0.30 | Yes | Yes | 3.24 | 75 | 95 | 44 | 1.997 | 0.76 |
| 3 | 0.30 | Yes | Yes | 3.25 | 72 | 98 | 65 | 1.997 | 0.71 |
| 4 | 0.30 | No | Yes | 3.25 | 81 | 94 | 74 | 1.998 | 0.72 |
| 5 | 0.30 | Yes | No | 3.25 | 73 | 99 | 85 | 1.998 | 0.84 |
| 6 | 0.30 | Yes | No | 3.25 | 156 | 88 | 86 | 1.997 | 0.82 |

TABLE 12

| Spec. No. | Cold-rolled thickness (mm) | Aging applied? Yes/No | Laser-beam irradiated? Yes/No | Si content (%) | Bi content (ppm) | Areal ratio of large grains in matrix (%) | Numerical ratio of fine grains (%) | $B_8$ (T) | $W_{17/50}$ (W/kg) |
|---|---|---|---|---|---|---|---|---|---|
| 7 | 0.23 | Yes | Yes | 3.24 | 0 | 20 | 13 | 1.908 | 0.76 |
| 8 | 0.23 | Yes | Yes | 3.25 | 78 | 99 | 51 | 1.992 | 0.66 |
| 9 | 0.23 | No | Yes | 3.24 | 77 | 97 | 53 | 1.994 | 0.68 |
| 10 | 0.23 | Yes | Yes | 3.25 | 155 | 99 | 71 | 1.993 | 0.61 |
| 11 | 0.23 | No | Yes | 3.25 | 165 | 98 | 88 | 1.991 | 0.60 |

What is claimed is:

1. A very high magnetic flux density grain-oriented electrical steel sheet comprising:

fine secondary recrystallized grains in a secondary recrystallization matrix;

said steel sheet is produced from an electrical steel composition consisting essentially of, by weight, 2.5 to 4.0 percent silicon, 0.03 to 0.15 percent carbon, 0.02 to 0.80 percent manganese, 0.005 to 0.040 percent sulfur, 0.010 to 0.065 percent acid soluble aluminum, 0.0030 to 0.0150 percent nitrogen, 0.002 to 0.010 percent bismuth, and the balance of iron and unavoidable impurities;

said steel sheet has a very high magnetic flux density $B_8$ of not less than 1.971 tesla;

80 percent or more, by area, of the grains in the secondary recrystallization matrix in a direction of cold rolling of said steel sheet having a diameter between 100 mm and 10 mm and in a direction perpendicular to the cold rolling direction of said steel sheet having a diameter between 50 mm and 5 mm, said grains being large secondary recrystallized grains; and 50 percent or more, by ratio of number, of the secondary recrystallized grains in the secondary recrystallization matrix are fine secondary recrystallized grains having a diameter of 5 mm or less.

2. The very high magnetic flux density grain-oriented electrical steel sheet according to claim 1, having a rolled surface wherein 90 percent or more, by ratio of area, of the large secondary grains have {110} axes inclined relative to the rolled surface less than 5 degrees with respect to a TD axis or ND axis; and 90 percent or more, by ratio of number, of all fine grains among the secondary recrystallization grains having a diameter of 5 mm or less have {110} axes inclined relative to the rolled surface not more than 10 degrees with respect to a TD axis or ND axis.

3. A very high magnetic flux density grain-oriented electrical steel sheet according to claim 1 wherein said electrical steel sheet composition further consists essentially of, by weight, 0.05 to 0.50 percent tin.

4. A very high magnetic flux density grain-oriented electrical steel sheet according to claim 1 wherein said electrical steel sheet composition further consists essentially of, by weight, 0.05 to 0.50 percent tin and 0.03 to 0.15 percent copper.

* * * * *